US005938313A

United States Patent [19]

Fujita

[11] Patent Number: 5,938,313

[45] Date of Patent: Aug. 17, 1999

[54] DEFORMABLE CHEMILUMINESCENCE ILLUMINANT

[75] Inventor: Masahiko Fujita, Koga, Japan

[73] Assignee: Nihon Kagaku Hakko, K.K., Koga, Japan

[21] Appl. No.: 08/959,307

[22] Filed: Oct. 28, 1997

[30] Foreign Application Priority Data

Jan. 31, 1997 [JP] Japan ..... 9-000752

[51] Int. Cl.[6] ..... F21K 2/06

[52] U.S. Cl. ..... 362/34; 362/806

[58] Field of Search ..... 362/34, 806; 206/219

[56] References Cited

U.S. PATENT DOCUMENTS

| | | | |
|---|---|---|---|
| 5,159,349 | 10/1992 | Holland et al. | 362/34 |
| 5,190,366 | 3/1993 | World | 362/34 |
| 5,222,797 | 6/1993 | Holland | 362/34 |
| 5,383,100 | 1/1995 | Kikos | 362/34 |
| 5,390,086 | 2/1995 | Holland | 362/34 |
| 5,508,893 | 4/1996 | Nowak et al. | 362/34 |
| 5,508,901 | 4/1996 | Kuo | 362/34 X |

*Primary Examiner*—Laura K. Tso

*Attorney, Agent, or Firm*—Armstrong, Westerman, Hattori, McLeland & Naughton

[57] ABSTRACT

A deformable chemiluminescence illuminant which provides a change of light emission directions to improve effects of light emission from the interior and light emission direction, which can be installed into a desired position with a stable state easily without handling troubles. A deformable chemiluminescence illuminant of the invention is characterized in that a soft, transparent, and elongate illuminant body provided with a hollow chamber filled with chemiluminescence liquid and an ampoule enclosing chemiluminescence liquid agent within the hollow chamber, wherein a configuration maintenance member which can be plastically-deformed with extrinsic power more than a given power is provided within the illuminant body along the longitudinal direction of the illuminant body.

11 Claims, 9 Drawing Sheets

DEFORMABLE CHEMILUMINESCENCE ILLUMINANT

BACKGROUND OF THE INVENTION

1. Field of The Invention

This invention relates to a chemiluminescence illuminant which can be deformed (altered) in its shape ad lib and is used as accessories, flood light, discernment light, emergency light, and so forth.

2. Description of the Related Art

The conventional chemiluminescence illuminant has a structure in which a soft, transparent and long illuminant body has a hollow chamber filled with chemiluminescence liquid therein and which receives an ampoule enclosing chemiluminescence liquid agent which can react with the chemiluminescence liquid to cause chemiluminescence reaction in the hollow chamber. This chemiluminescence illuminant has no configuration maintenance member which keeps the illuminant body in a deformed condition, therefore, the illuminant body is used in an elongate condition. As a result, in the conventional chemiluminescence illuminant, the ampoule is collapsed by bending the illuminant body by hand, which causes the chemiluminescence reaction of the chemiluminescence liquid agent in the ampoule with the chemiluminescence liquid so as to emit light. However, the emitting light is a monotonous emission that is emitted radially from the center axis of the illuminant body.

Furthermore, where the conventional chemiluminescence illuminant is used in an elongate condition, it is difficult to install the illuminant body into a desired position and it is required to use stands or bindings for installing it.

SUMMARY OF THE INVENTION

The primary purpose of the invention is to provide a deformable chemiluminescence illuminant which overcomes the above problems and gives a change of light emission directions to improve the effects of light emission from the interior and light emission direction, and can be installed into a desired position with a stable state easily without handling troubles.

The present invention solves the above problems by providing a deformable (alterable) chemiluminescence illuminant characterized in that a soft (flexible), transparent, and elongate illuminant body has a hollow chamber filled with chemiluminescence liquid and an ampoule enclosing chemiluminescence liquid agent which reacts with the above mentioned chemiluminescence liquid to cause a chemiluminescence reaction, and in that a configuration maintenance member which can be plastically-deformed with extrinsic power more than a given power is provided within the illuminant body along the longitudinal direction of said illuminant body so as to maintain the illuminant body in a desired deformed (altered) shape.

A deformable chemiluminescence illuminant according to the present invention can include a stowage space for the configuration maintenance member in the center of the illuminant body along the longitudinal direction of the illuminant body so as to receive the configuration maintenance member in the stowage space.

A deformable chemiluminescence illuminant according to the present invention can be provided with a stowage space for the configuration maintenance member in both side ends of the illuminant body along the longitudinal direction of the illuminant body so as to receive the configuration maintenance member in each stowage space.

A deformable chemiluminescence illuminant according to the present invention can also be provided with a stowage space for the configuration maintenance member in one side end of the illuminant body along the longitudinal direction of the illuminant body so as to receive the configuration maintenance member in the stowage space.

A deformable chemiluminescence illuminant according to another embodiment of the invention provides the configuration maintenance member in the hollow chamber which is filled with the chemiluminescence liquid.

In one embodiment of the invention, a plastically deformable metal stick is used as the configuration maintenance chamber.

The invention further provides a deformable chemiluminescence illuminant, wherein an opaque resin film covers the surface of the configuration maintenance member.

In a further embodiment, the color of the film is the same as that of the illuminant body.

The present invention also provides a deformable chemiluminescence illuminant, wherein several hollow chambers are provided and the chemiluminescence reaction of the chemiluminescence liquid in each chamber with the chemiluminescence liquid agent produces two or more colors.

In a further embodiment of the deformable chemiluminescence illuminant according to the present invention, the hollow chamber is provided along the longitudinal direction of the illuminant body and the hollow chamber receives several ampoules enclosing several chemiluminescence liquid agents which react with the chemiluminescence liquid so as to produce different colors from each other.

In yet another embodiment, a deformable chemiluminescence illuminant is provided, wherein a partition is provided between ampoules in the hollow chamber to partition off the hollow chamber such that each chemiluminescence liquid agent of each ampoule is prevented from mixing with each other so as to emit each color independently in the same hollow chamber.

BRIEF DESCRIPTION OF DRAWINGS

The description of the invention is made with reference to the drawings, in which.

DETAILED DESCRIPTION OF PREFERRED EMBODIMENTS

Figure 1:
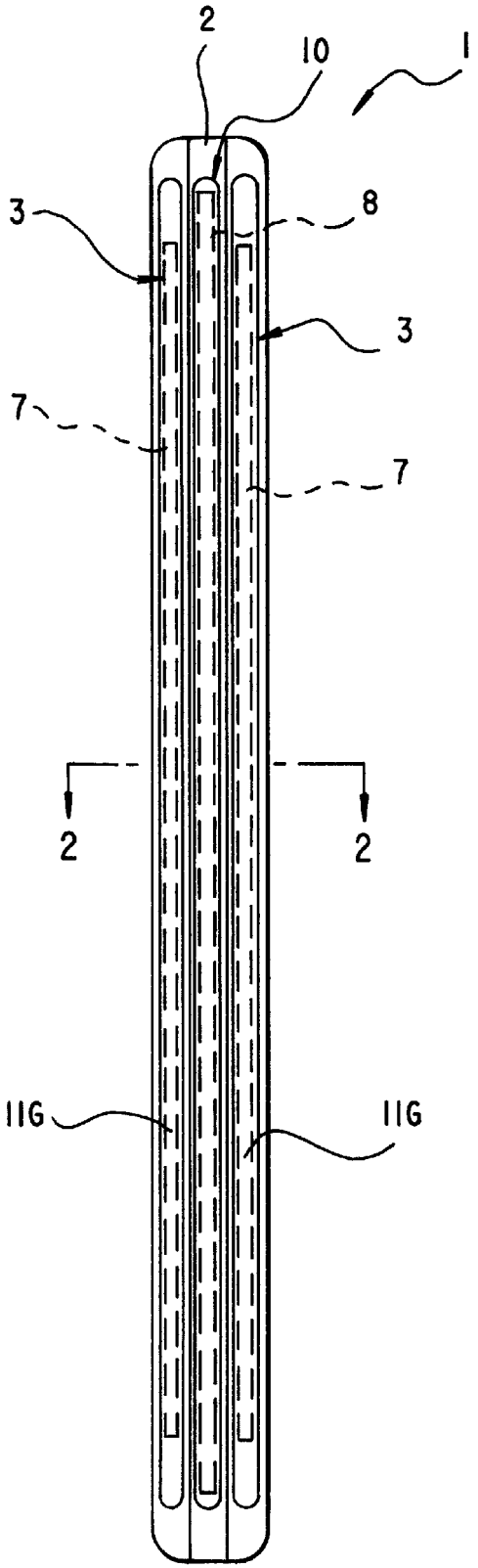
FIG. 1 is front elevation of the chemiluminescence illuminant of Example 1.
Figure 2:
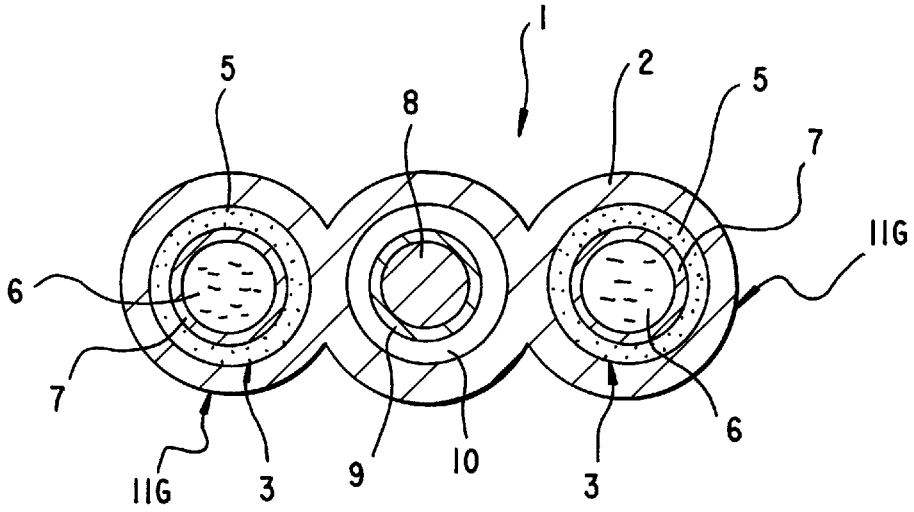
FIG. 2 is a cross-sectional view along line A—A of FIG. 1.
Figure 3:
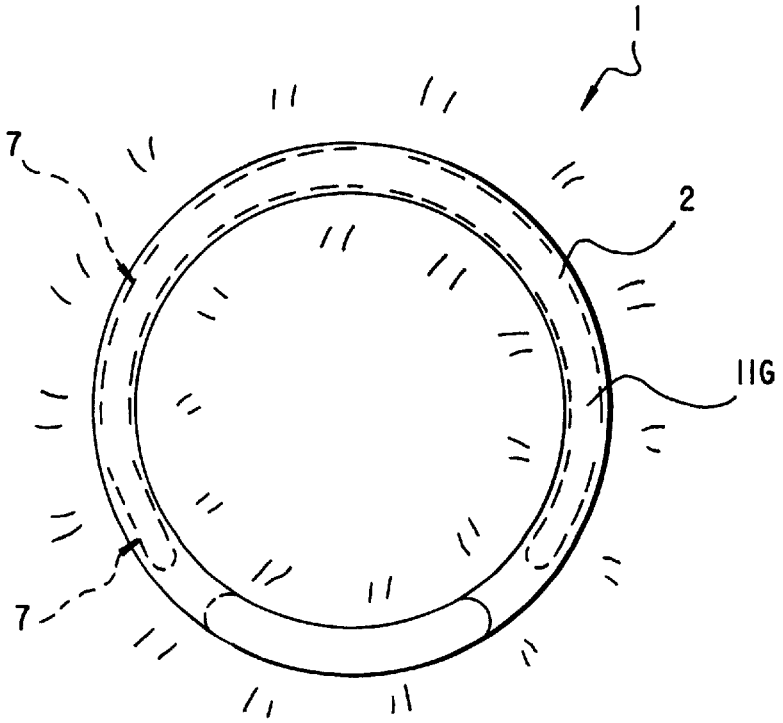
FIG. 3 is plan view showing the condition when the illuminant of Example 1 is bent spirally.
Figure 4:
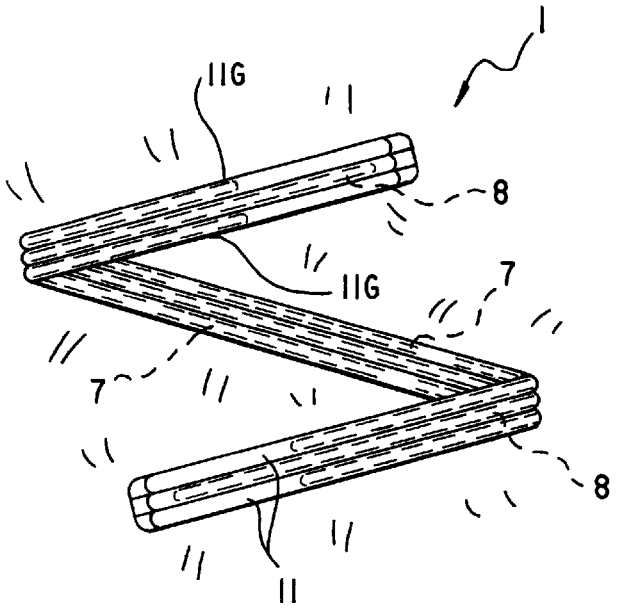
FIG. 4 is front elevation showing the condition when the illuminant of Example 1 is bent spirally.
Figure 5:
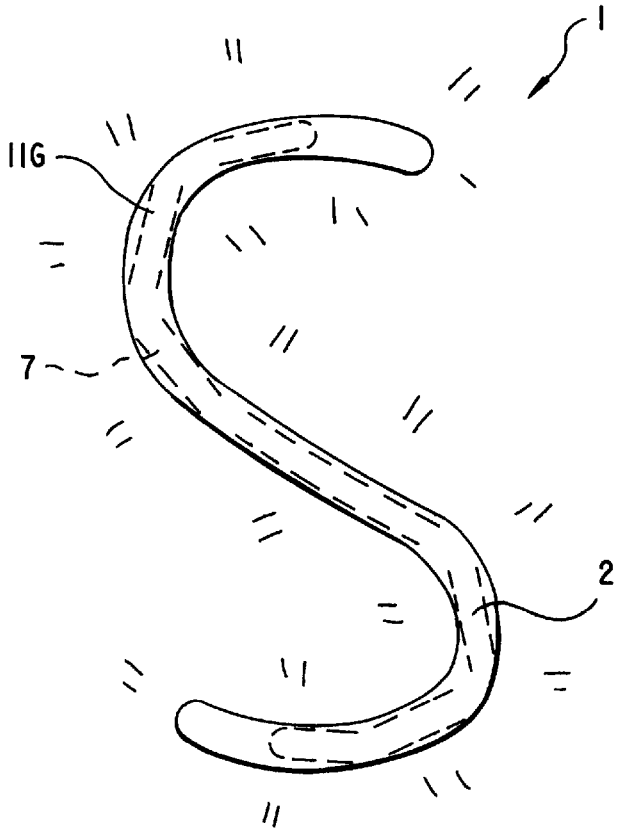
FIG. 5 is the plan view showing the condition when the illuminant of Example 1 is bent with an S-shape.

The illuminant of this invention receives an ampoule enclosing a chemiluminescence liquid agent and a chemiluminescence liquid in a hollow chamber, and when a user collapses the ampoule by bending the illuminant so as to bend the hollow chamber or by squeezing the exterior of the illuminant body around the hollow chamber, the chemiluminescence liquid is mixed with the chemiluminescence liquid agent to cause the chemiluminescence reaction which emits light from the hollow chamber.

The chemiluminescence illuminant which emits light can be altered to a shape suitable for an installation position or a shape responding to a using condition by hand.

The deformable chemiluminescence illuminant is maintained in an altered condition with a configuration maintenance member.

Furthermore, deformation of the shape of the chemiluminescence illuminant leads to changing of light emission directions and improves effects of light emission direction and light emission from the interior.

Where the illuminant has several hollow chambers, a user can collapse an ampoule in a certain chamber by bending the hollow chamber which is to emit light or squeezing the illuminant body around it, thereby mixing the chemiluminescence liquid with the chemiluminescence liquid agent, and causing chemiluminescence reaction to emit light from only that chamber. Therefore, a user can choose a particular area to emit light without having to emit light from the entire illuminant.

The increase of the number of the hollow chambers which emits light at one time enables an increase in the amount of emission easily by increasing the area of emission. Furthermore, if hollow chambers are activated in a sequence so that a certain hollow chamber emits light and after the emission of the hollow chamber has decreased, another hollow chamber is activated, the continuous term for emitting light can be lengthened. Furthermore, the remaining hollow chambers which are not activated can be used on another day.

The illuminant of the invention can be used according to purposes of utilization and is economical.

If all chemiluminescence colors from each hollow chamber are the same, the amount of the emission and the area of emission of the same chemiluminescence light can be controlled, and the continuous term for emission of the same color can be lengthened.

If each chemiluminescence color from each hollow chamber is different from each other, one illuminant can emit various different colors according to purposes of utilization, or emit chemiluminescence color of the combination of different colors to improve discrimination and display, or lengthen the continuous term of emission by emitting different colors in sequence.

Where each hollow chamber emits two or more chemiluminescence colors and at least two hollow chambers emit the same kind of color, if the chemiluminescence color emitted from these two or more hollow chambers has high emission frequency or needs to have a lot of emission amount or emission area, the illuminant is easy to be used for any purpose of utilization.

Where a chemiluminescence illuminant receives several ampoules in the same hollow chamber and has partitions between ampoules in each hollow chamber to separate the hollow chamber into several compartments, the partitions prevent the chemiluminescence liquid agent enclosed in each ampoule from mixing with each other and enables the illuminant to emit several emission colors in the same hollow chamber independently.

Generally, brass, copper wire and steel wire are used as a configuration maintenance member. Also it is preferred that the surface of a configuration maintenance member is covered with a resin film to improve the appearance of it. The color of the film is near to or the same as the color of the illuminant body, but can be various colors according to the color emitted from the hollow chamber.

It is common that the configuration maintenance members are received in the stowage spaces provided in the illuminant body along the longitudinal direction of the illuminant body, but the configuration maintenance members can be received in hollow chambers or be embedded within a wall of the illuminant body.

One or several hollow chambers which emits light by chemiluminescence reaction is provided in the illuminant body. If several chambers are provided, they are aligned along the longitudinal direction of the illuminant body or they are placed along the direction across the longitudinal direction of the illuminant body, or they can be placed for many rows and many arrangements in the illuminant body.

Each emission color emitted from each hollow chamber can be the same color or be different from each other, furthermore, one kind of color can be emitted from at least two hollow chambers. The shape of the partition can be cylindrical, circular, spherical, reverse truncated cone shape, etc. These partitions can generally be made of polyethylene or metal.

A better understanding of the preferred embodiments of the invention is made by reference to the following examples, which are not to be considered as limiting the invention to these specific embodiments.

EXAMPLE 1

In FIGS. 1–6, the numeral 1 indicates a chemiluminescence illuminant, the numeral 2 indicates a soft, transparent and elongate illuminant body of about 30 cm of length, 2 cm of cross length and 5 mm of thickness, the numeral 3 indicates a hollow chamber, the numeral 5 indicates chemiluminescence liquid, the numeral 6 indicates chemiluminescence liquid agent, the numeral 7 indicates an ampoule enclosing the chemiluminescence liquid agent 6, the numeral 8 indicates a configuration maintenance member of about 30 cm or less in length and about 3 mm of diameter made of brass, the numeral 9 indicates a white resin film covering the surface of the configuration maintenance member 8, the numeral 10 indicates a stowage space for receiving the configuration maintenance member 8 and the numeral 11G indicates a green emission part where the emission light is green.

The chemiluminescence illuminant 1 of Example 1 shown in FIGS. 1–6 receives a configuration maintenance member 8 into a stowage space 10 disposed in the middle of the illuminant body 2 along the longitudinal direction of the illuminant body 2, and forms hollow chambers 3 which are almost as long as the stowage space 10 on both side ends of the illuminant body 2 wherein the stowage space 10 is positioned between those hollow chambers 3. Each hollow chamber 3 is filled with ampoules 7 which enclose chemiluminescence liquid agent 6, and chemiluminescence liquid 5.

The emission of the chemiluminescence illuminant 1 is accomplished by bending the hollow chambers 3 which are to emit light to collapse an ampoule 7 in it, and mixing the chemiluminescence liquid agent 6 in the ampoule 7 with the chemiluminescence liquid 5, thereby emitting green light from the hollow chambers 3 from a chemical reaction.

Figure 6:
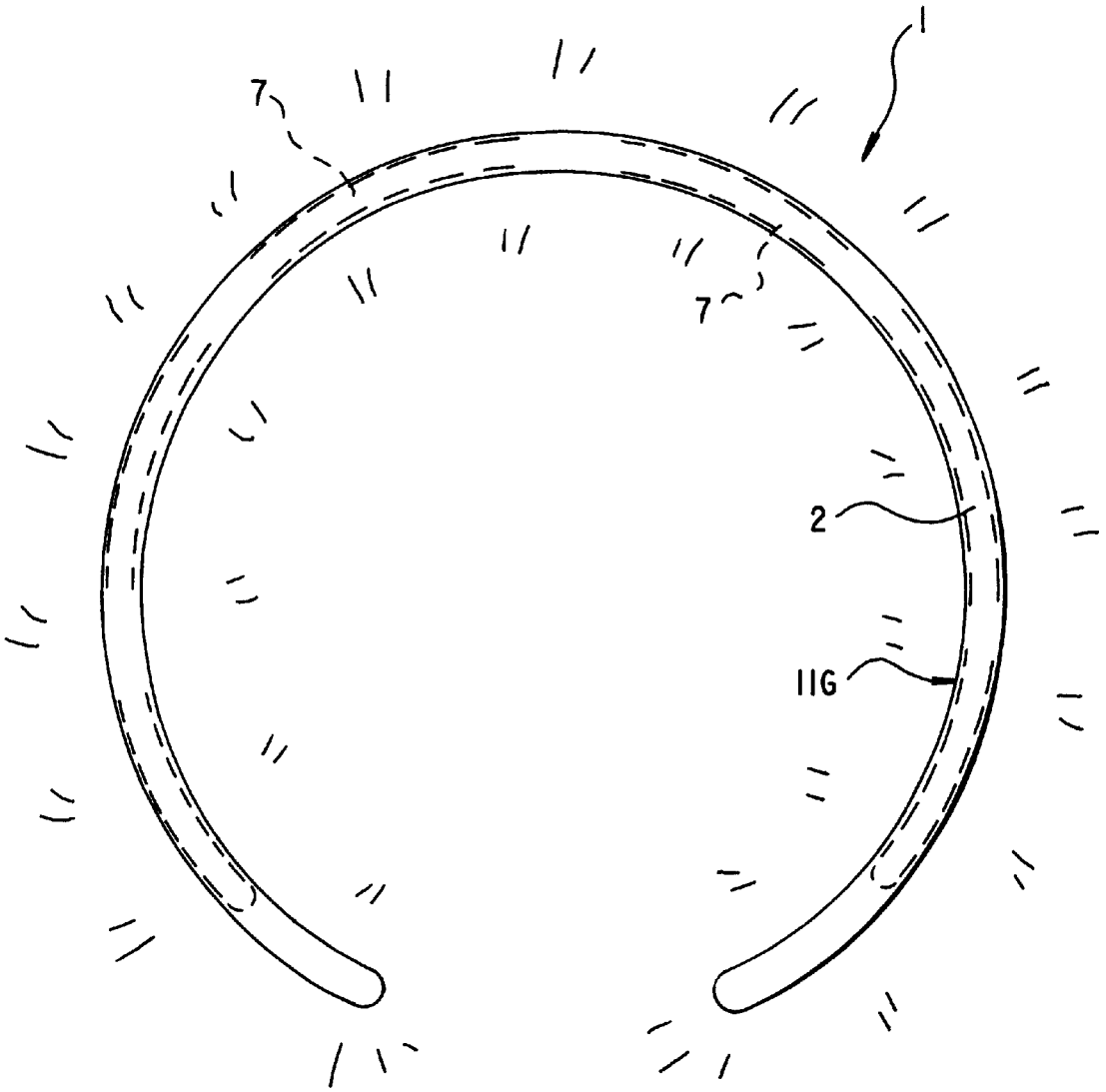
FIG. 6 is a plan view showing the condition when the illuminant of Example 1 is bent with a ring-shape.

Subsequently, the configuration of the chemiluminescence illuminant 1 can be deformed to be fitted to a desired installation position by bending, for example, into a spiral shape (see FIGS. 3 and 4), S-shape (FIG. 5) or ring-shape (FIG. 6).

The altered configuration of the chemiluminescence illuminant 1 is maintained with the configuration maintenance member 8. The chemiluminescence illuminant 1 can be altered several times.

The configuration maintenance member 8 is made of brass. However, since the surface of the configuration maintenance member 8 is covered with white resin film 9 to hide the color of brass, the use of brass does not impair the color of emission and appearance of the illuminant 1 and enables the color of emission to be vivid by reflecting the emission on the film 9 as well as the appearance of the illuminant to become beautiful.

Altering and maintaining illuminant 1 in such an altered configuration avoids the conventional monotonous emission radially from the center of the elongate cylindrical illuminant, and can change light emission direction, that is, can vary light emission direction and improve the effects of light emission direction and light emission from the interior.

EXAMPLE 2

Figure 7:
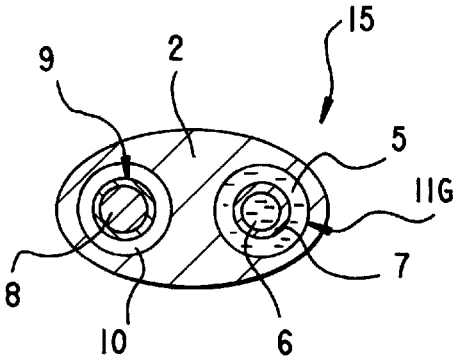
FIG. 7 is a cross-sectional view showing the internal structure of the illuminant of Example 2.

The numeral 15 of FIG. 7 indicates a chemiluminescence illuminant.

The chemiluminescence illuminant 15 of Example 2 shown in FIG. 7 has the structure in which the hollow chamber 3 is positioned on one side end portion of the illuminant body 2 and the stowage space 10 is positioned on the other side end portion of the illuminant for receiving the configuration maintenance member 8 and the configuration maintenance member 8 is received in the stowage space 10.

Other symbols, components, functions and effects are the same as those of the above Example 1.

EXAMPLE 3

Figure 8:
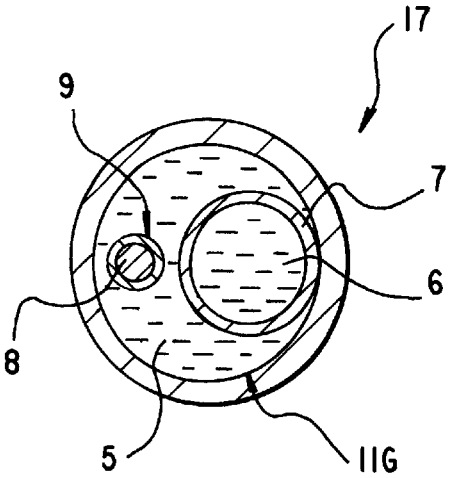
FIG. 8 is a cross-sectional view showing the internal structure of the illuminant of Example 3.

The numeral 17 of FIG. 8 indicates a chemiluminescence illuminant.

The chemiluminescence illuminant 17 of Example 3 in FIG. 8 is an example in which the illuminant does not have a stowage space for receiving the configuration maintenance member 8 and receives the configuration maintenance member 8 in the hollow chamber 3.

The configuration maintenance member 8 is covered with the film 9.

Other symbols, components, functions and effects are the same as those of the above Example 1.

EXAMPLE 4

Figure 9:
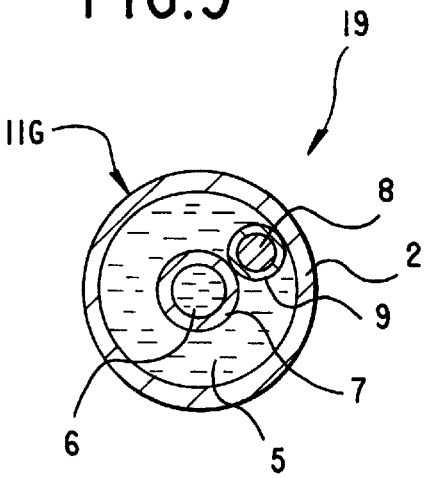
FIG. 9 is a cross-sectional view showing the internal structure of the illuminant of Example 4.

The numeral 19 of the FIG. 9 indicates a chemiluminescence illuminant.

The chemiluminescence illuminant 19 of the Example 4 in FIG. 9 has a structure in which the stowage space 10 for receiving the configuration maintenance member 8 is positioned in the center of the illuminant body 2, the configuration maintenance member 8 is received in the stowage space 10, and the film 9 covers the configuration maintenance member 8.

Other symbols, components, functions and effects are the same as those of the above Example 1.

EXAMPLE 5

Figure 10:
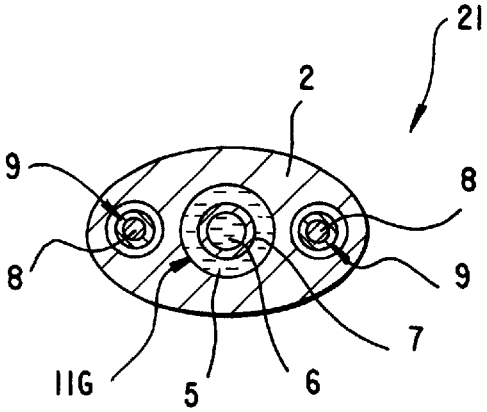
FIG. 10 is cross-sectional view showing the internal structure of the illuminant of Example 5.

The numeral 21 of FIG. 10 indicates a chemiluminescence illuminant.

The chemiluminescence illuminant 21 of Example 5 in FIG. 10 is an example in which the hollow chamber 3 is positioned in the center of the illuminant body 2, the stowage spaces 10 for receiving the configuration maintenance member 8 are positioned on both side end portions of the illuminant such that the hollow chamber is positioned between the stowage spaces, and the configuration maintenance member 8 is received in the stowage spaces 10.

Other symbols, components, functions and effects are the same as those of the above Example 1.

EXAMPLE 6

Figure 11:
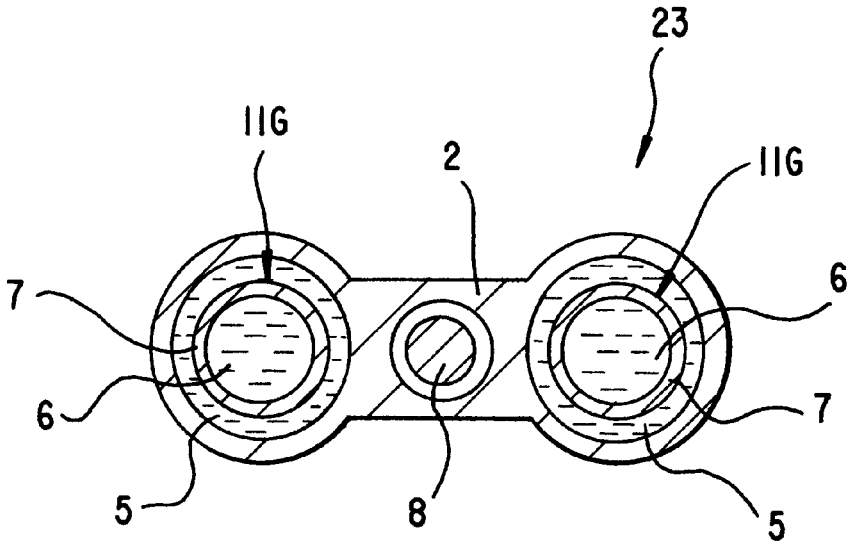
FIG. 11 is a cross-sectional view showing the internal structure of the illuminant of Example 6.

The numeral 23 of FIG. 11 indicates a chemiluminescence illuminant.

The chemiluminescence illuminant 23 of the Example 6 in FIG. 11 is an example in which the stowage space 10 for receiving the configuration maintenance member 8 is positioned in the center of the illuminant body 2 and hollow chambers 3 are positioned on both side end portions of the illuminant 2.

The diameter of the hollow chamber 3 is larger than that of the stowage space and the configuration maintenance member 8 is not covered with the film 9.

Other symbols, components, functions and effects are the same as those of the above Example 1.

EXAMPLE 7

Figure 12:
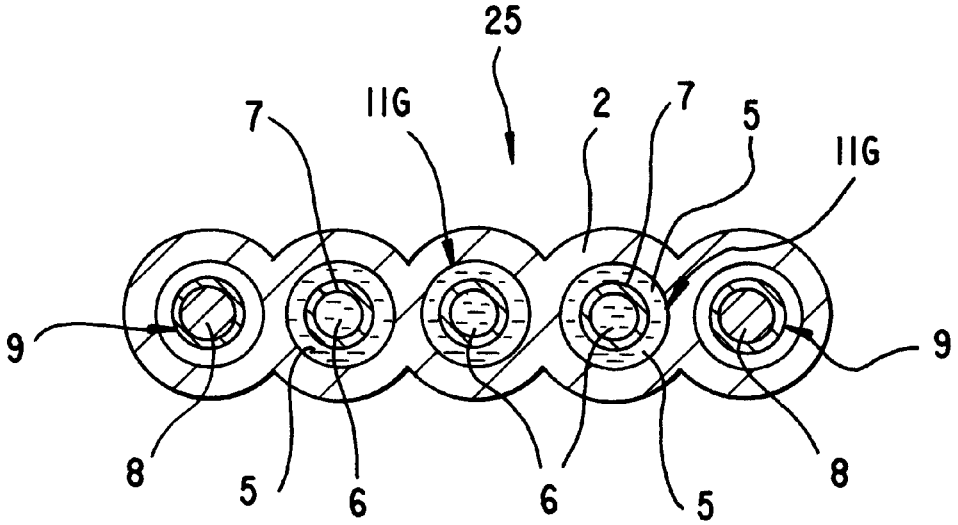
FIG. 12 is a cross-sectional view showing the internal structure of the illuminant of Example 7.

The numeral 25 of the FIG. 12 indicates a chemiluminescence illuminant.

The chemiluminescence illuminant 25 of Example 7 in FIG. 12 is an example in which the stowage spaces 10 for receiving the configuration maintenance member 8 are positioned on the both side end portions of the illuminant body 2, the configuration maintenance members 8 are received in each stowage space 10, and three hollow chambers 3 are positioned between the stowage spaces 10.

Other symbols, components, functions and effects are the same as those of the above Example 1.

EXAMPLE 8

Figure 13:
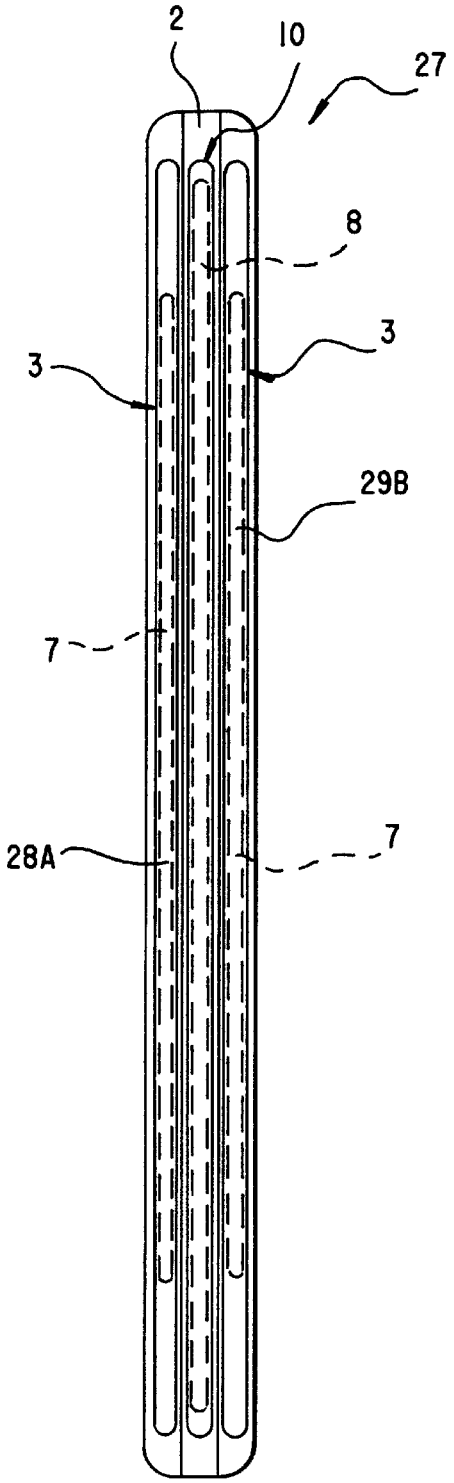
FIG. 13 is a front elevation of the chemiluminescence illuminant of Example 8.

The numeral 27 of FIG. 13 indicates a chemiluminescence illuminant, the numeral 28A indicates a red emission part in which emitting light is red and the numeral 29B indicates a blue emission part in which emitting light is blue.

The chemiluminescence illuminant 27 of Example 8 in FIG. 13 has the same structure as the chemiluminescence illuminant 1 of the Example 1, except that in the example of FIG. 13 the hollow chamber 3 on the left side is red emission part 28A and the hollow chamber 3 on the right side is blue emission part 29B.

As a result, the chemiluminescence illuminant 27 is improved in effects of direction and discrimination ability.

Other symbols, components, functions and effects are the same as those of the above Example 1.

EXAMPLE 9

Figure 14:
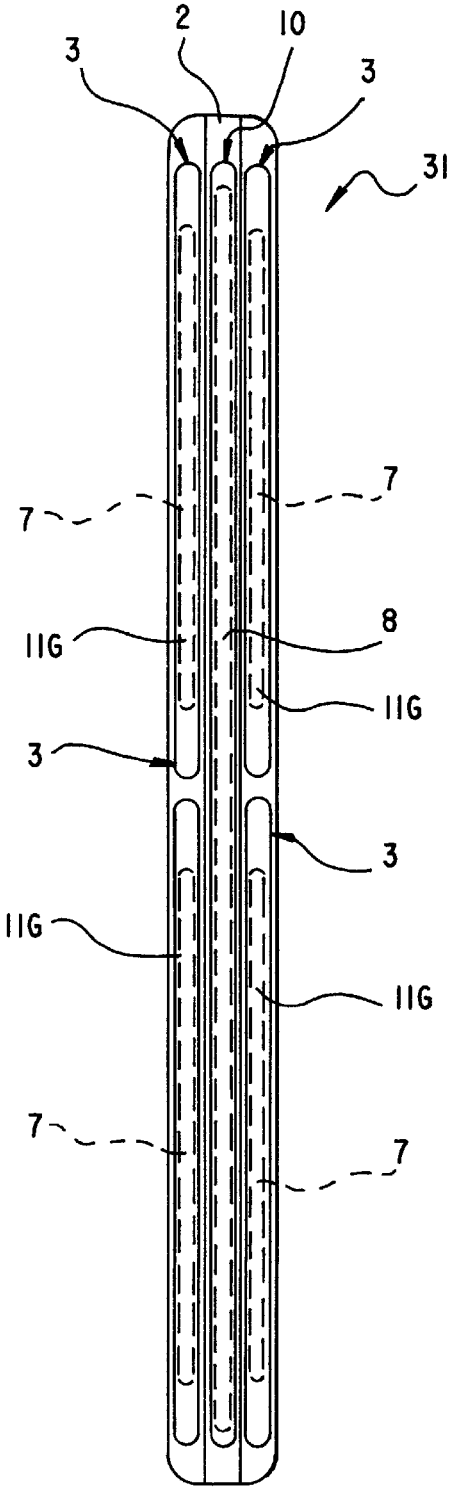
FIG. 14 is a front elevation of the chemiluminescence illuminant of Example 9.

The numeral 31 of FIG. 14 indicates a chemiluminescence illuminant.

The chemiluminescence illuminant 31 of Example 9 in FIG. 14 is an example which has the same structure as the chemiluminescence illuminant 1 of Example 1, except that in illuminant 31 each hollow chamber 3 is partitioned into two parts vertically. Each of four hollow chambers 3 has a green emission part 11G in which the emission light is green.

Other symbols, components, functions and effects are the same as those of the above Example 1.

EXAMPLE 10

Figure 15:
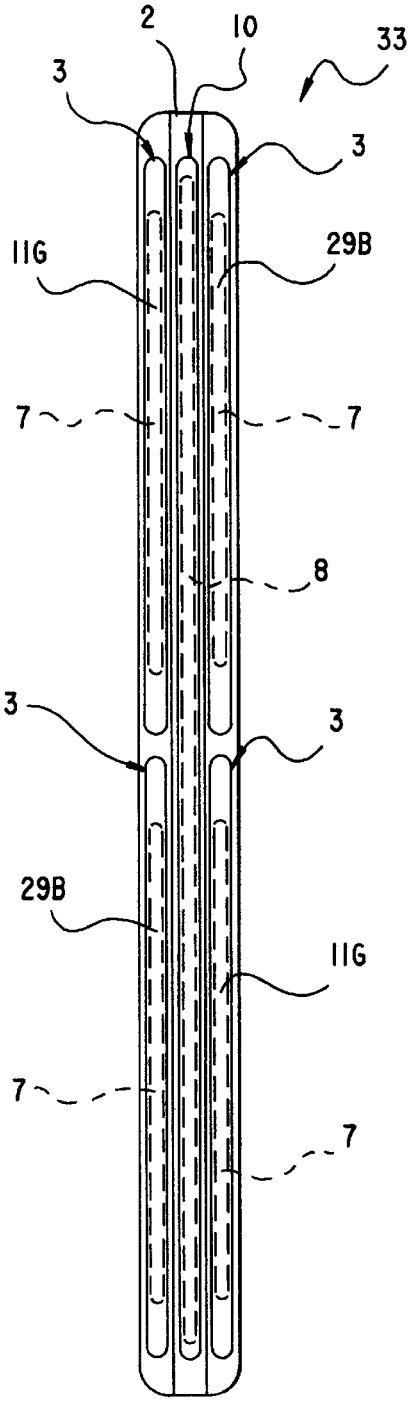
FIG. 15 is a front elevation of the chemiluminescence illuminant of Example 10.

The numeral 33 of FIG. 15 indicates a chemiluminescence illuminant.

The chemiluminescence illuminant 33 of Example 10 in FIG. 15 is an example which has the same structure as the above chemiluminescence illuminant 31 of Example 9, except that the hollow chamber 3 is divided into 4 parts and the hollow chambers 3 of the upper right side and lower left side in the figure are blue emission parts 29B, and the remaining two chambers are green emission parts 11G.

The number of the hollow chambers 3 and emitting light color are two colors so as to improve the effect of direction and discrimination.

Other symbols, components, functions and effects are the same as those of the above Example 1.

EXAMPLE 11

Figure 16:
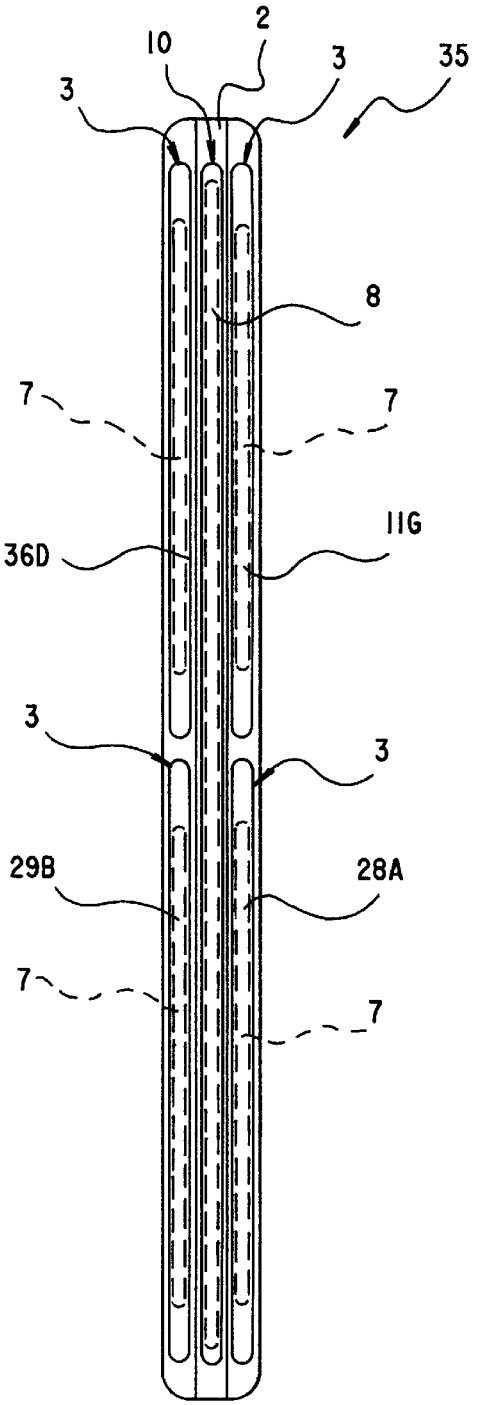
FIG. 16 is a front elevation of the chemiluminescence illuminant of Example 11.

The numeral 35 of FIG. 16 indicates a chemiluminescence illuminant and the numeral 36D indicates an orange emission part in which the emission light is orange.

The chemiluminescence illuminant 35 of Example 11 in FIG. 16 has the same structure as the chemiluminescence illuminant 31 of Example 9, except that in the example of FIG. 16 the hollow chamber 3 on the upper right side is green emission part 11G, the hollow chamber 3 on the upper left side is orange emission part 36D, the hollow chamber 3 on the lower right side is red emission part 28A and the hollow chamber 3 on the lower left side is blue emission part 29B.

The number of the hollow chambers and emitting light colors are four colors so as to improve the effect of direction and discrimination.

Other symbols, components, functions and effects are the same as those of the above Example 1.

EXAMPLE 12

Figure 17:
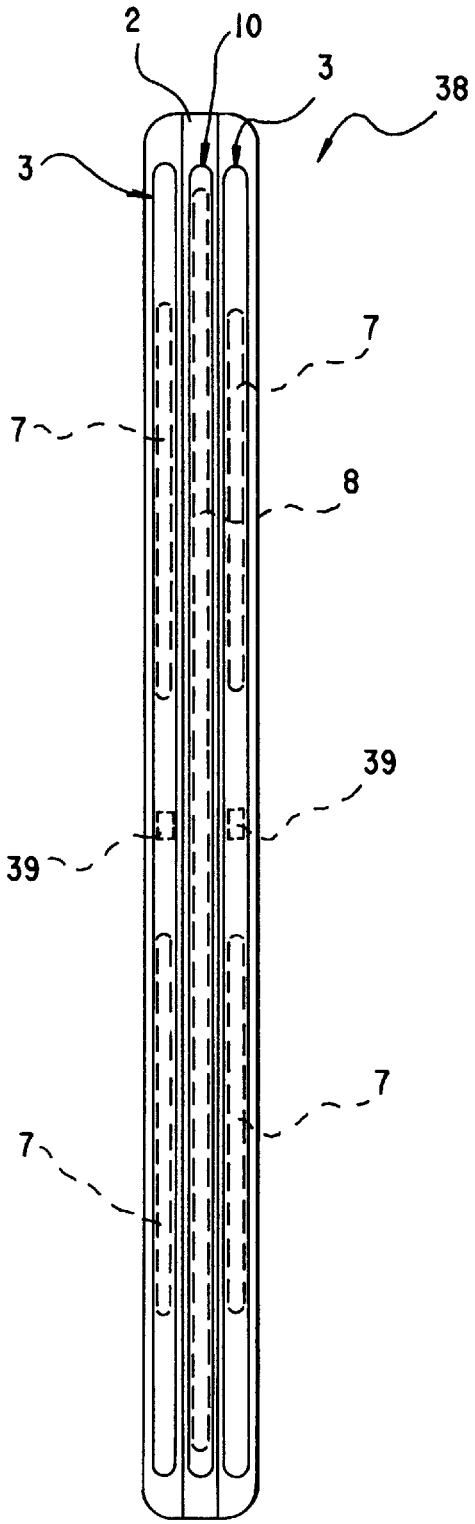
FIG. 17 is a front elevation of the chemiluminescence illuminant of Example 12.
Figure 18:
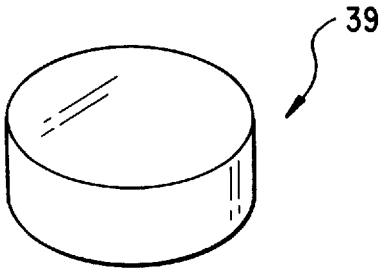
FIG. 18 is a perspective diagram showing the partition in the chemiluminescence illuminant of Example 12.

The numeral 38 of the FIG. 17 indicates a chemiluminescence illuminant in which several ampoules are received in the same hollow chamber 3 and the numeral 39 indicates a partition which is made of polyethylene with a cylindrical shape (see FIG. 18) to partition the hollow chamber 3 by being positioned between each ampoule 7 in the hollow chamber 3.

The chemiluminescence illuminant 38 of Example 12 in FIG. 17 has the same structure as that of the chemiluminescence illuminant 1 of Example 1, except that the illuminant receives two ampoules 7 in each hollow chamber 3, and partitions 39 are positioned between the ampoules in the hollow chamber 3 so as to partition the hollow chamber 3 into two parts vertically.

Each chemiluminescence liquid agent 6 enclosed in each ampoule 7 in the same hollow chamber 3 is prevented from mixing with each other by the partitions, which enables to emit different colors in the same hollow chamber 3 dependently.

In the chemiluminescence illuminant 38 of the FIG. 17, the partitioned room of the upper portion of the right hollow chamber 3 is for a green emission part 11G, the partitioned room of the lower portion of the right hollow chamber 3 is for a red emission part 28A, the partitioned room of the upper portion of the left hollow chamber 3 is for an orange emission part 36D and the partitioned room of the lower portion of the left hollow chamber 3 is for a blue emission part 29B.

Preventing each emitting light from mixing with each other so as to emit light dependently improves the effect of direction and discrimination.

Other symbols, components, functions and effects are the same as those of the above Example 1.

EXAMPLES OF OTHER PARTITIONS

Figure 19:
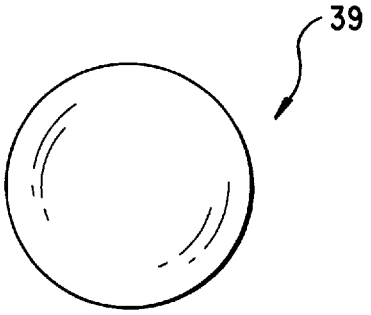
FIG. 19 is a perspective diagram showing an alternative configuration of the partition.
Figure 20:
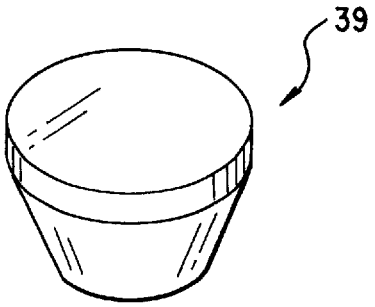
FIG. 20 is a perspective diagram showing an alternative configuration of the partition.

FIGS. 19 and 20 show other examples of partitions 39. The partition shown in FIG. 19 is spherical. The partition shown in the FIG. 20 is a reverse circular truncated cone.

According to the invention, the chemiluminescence illuminant can be deformed ad lib and maintained with such deformed configuration. As a result, the illuminant avoids the problem that the emitting light is a monotonous emission emitted radially from the center axis of the illuminant body, can give change of light emission directions to improve effects of light emission from the interior and light emission direction, and can be deformed into a proper shape and installed in a desired position such as articles, body, clothes, tables and so forth with a stable state easily without handling troubles.

We claim:

1. A deformable chemiluminescence illuminant, comprising:

a flexible, transparent, and elongate illuminant body;

a hollow chamber within said body containing a chemiluminescence liquid and an ampoule enclosing a chemiluminescence liquid agent which reacts with said chemiluminescence liquid to cause a chemiluminescence reaction; and a deformable configuration maintenance member provided within said illuminant body along a longitudinal direction of said illuminant body so as to maintain said illuminant body in an altered state.

2. A deformable chemiluminescence illuminant according to claim 1, further comprising a stowage space receiving the configuration maintenance member, said stowage space being provided in a center of the illuminant body along the longitudinal direction of said illuminant body.

3. A deformable chemiluminescence illuminant according to claim 1, further comprising a stowage space receiving the configuration maintenance member, said stowage space being provided in both side ends of the illuminant and extending body along the longitudinal direction of said illuminant body.

4. A deformable chemiluminescence illuminant according to claim 1, further comprising a stowage space receiving the configuration maintenance member in one side end of the illuminant body and extending along the longitudinal direction of said illuminant body.

5. A deformable chemiluminescence illuminant according to claim 1, wherein the configuration maintenance member is provided within the hollow chamber filled with the chemiluminescence liquid.

6. A deformable chemiluminescence illuminant according to claim 1, wherein the configuration maintenance member is a plastically deformable metal stick.

7. A deform able chemiluminescence illuminant according to claim 1, further comprising an opaque resin film covering a surface of the configuration maintenance member.

8. A deformable chemiluminescence illuminant according to claim 7, wherein a color of the film is the same as a color of the illuminant body.

9. A deformable chemiluminescence illuminant according to claim 1, comprising a plurality of hollow chambers so that the chemiluminescence reaction of the chemiluminescence liquid in each chamber with the chemiluminescence liquid agent produces at least two colors.

10. A deformable chemiluminescence illuminant according to claim 1, wherein the hollow chamber is provided along the longitudinal direction of the illuminant body and said hollow chamber receives several ampoules enclosing several chemiluminescence liquid agents which react with the chemiluminescence liquid so as to produce different colors from another.

11. A deformable chemiluminescence illuminant according to claim 10, wherein a partition is provided between ampoules in the hollow chamber to partition off said hollow chamber such that each chemiluminescence liquid agent of each ampoule is prevented from mixing with another to emit each color independently in the same hollow chamber.

* * * * *